US011761659B2

(12) United States Patent
Park

(10) Patent No.: US 11,761,659 B2
(45) Date of Patent: Sep. 19, 2023

(54) METHOD FOR PREDICTING AIR-CONDITIONING LOAD ON BASIS OF CHANGE IN TEMPERATURE OF SPACE AND AIR-CONDITIONER FOR IMPLEMENTING SAME

(71) Applicant: LG ELECTRONICS INC., Seoul (KR)

(72) Inventor: Yun Sik Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/621,487

(22) PCT Filed: Jun. 24, 2019

(86) PCT No.: PCT/KR2019/007613
§ 371 (c)(1),
(2) Date: Dec. 21, 2021

(87) PCT Pub. No.: WO2020/262717
PCT Pub. Date: Dec. 30, 2020

(65) Prior Publication Data

US 2022/0349606 A1 Nov. 3, 2022

(51) Int. Cl.
*F24F 11/58* (2018.01)
*F24F 11/65* (2018.01)
(Continued)

(52) U.S. Cl.
CPC ..... *F24F 11/58* (2018.01); *F24F 11/65* (2018.01); *F24F 2110/10* (2018.01); *F24F 2110/20* (2018.01)

(58) Field of Classification Search
CPC .. F24F 11/30; F24F 11/62; F24F 11/64; F24F 11/65; F24F 11/63; F24F 2110/10;
(Continued)

(56) References Cited

U.S. PATENT DOCUMENTS 5,372,015 A * 12/1994 Suzuki ..... F24F 11/67 236/78 D
5,555,927 A * 9/1996 Shah ..... G05D 23/1904 165/239
(Continued)

FOREIGN PATENT DOCUMENTS

JP 2015-75302 A 4/2015
JP 2016-99050 A 5/2016
(Continued)

*Primary Examiner* — Darrin D Dunn
(74) *Attorney, Agent, or Firm* — Birch, Stewart, Kolasch & Birch, LLP

(57) ABSTRACT

The present disclosure relates to a method of predicting air conditioning load based on room temperature and an air conditioner implementing the method, the air conditioner according to one embodiment may include a sensor configured to sense a room temperature or humidity in a suspended section in which an air discharge part is not operated; and a central controller implemented to control the air discharge part and an outdoor unit based on operation mode information that is calculated from a value sensed by the sensor, when the air discharge part and the outdoor unit are switched on.

20 Claims, 9 Drawing Sheets

(51) Int. Cl.
*F24F 110/20* (2018.01)
*F24F 110/10* (2018.01)

(58) Field of Classification Search
CPC ..... F24F 2120/10; F24F 11/48; G05B 15/02; G05B 2219/2614; G05B 19/042; G05B 2219/2642; G05B 13/00; G06N 20/00
See application file for complete search history.

(56) References Cited

U.S. PATENT DOCUMENTS

| | | | | |
|---|---|---|---|---|
| 7,502,768 | B2 * | 3/2009 | Ahmed | G06N 3/02 706/30 |
| 10,871,302 | B2 * | 12/2020 | Song | F24F 11/64 |
| 11,353,226 | B2 * | 6/2022 | Park | G05B 13/027 |
| 2008/0099570 | A1 * | 5/2008 | Krebs | F23N 5/203 236/46 R |
| 2015/0027152 | A1 * | 1/2015 | Marco | B60H 1/321 62/126 |
| 2016/0201934 | A1 * | 7/2016 | Hester | F24F 11/89 700/276 |
| 2018/0195752 | A1 * | 7/2018 | Sasaki | F24F 11/80 |
| 2019/0024925 | A1 * | 1/2019 | Wu | G05B 19/042 |
| 2019/0353375 | A1 * | 11/2019 | Brahme | F24F 11/65 |
| 2020/0080742 | A1 * | 3/2020 | Okamoto | F24F 11/56 |
| 2021/0018208 | A1 * | 1/2021 | Shin | F24F 8/80 |
| 2021/0041121 | A1 * | 2/2021 | Park | F24F 11/56 |
| 2021/0088240 | A1 * | 3/2021 | Ohta | G05B 19/042 |

FOREIGN PATENT DOCUMENTS

| | | | |
|---|---|---|---|
| JP | 2017-87427 | A | 4/2017 |
| KR | 10-2013-0120603 | A | 11/2013 |
| KR | 10-2015-0125343 | A | 11/2015 |
| KR | 10-1776567 | B1 | 9/2017 |
| KR | 10-1875488 | B1 | 7/2018 |

* cited by examiner

METHOD FOR PREDICTING AIR-CONDITIONING LOAD ON BASIS OF CHANGE IN TEMPERATURE OF SPACE AND AIR-CONDITIONER FOR IMPLEMENTING SAME

CROSS-REFERENCE TO RELATED APPLICATIONS

This application is the National Stage filing under 35 U.S.C. § 371 of International Application No. PCT/KR2019/007613, filed on Jun. 24, 2019, the contents of which are all hereby incorporated by reference herein in their entirety.

TECHNICAL FIELD

Disclosed herein is a method of predicting air conditioning load based on temperature change of space, and air conditioning of implementing thereof.

BACKGROUND

An air conditioner is configured to adjust room temperatures and purify room air by discharging cold and warm air to a room, so as to provide humans with a pleasant indoor environment.

Generally, such an air conditioner may include an indoor unit installed in a room and an outdoor unit configured of a compressor and a heat exchanger to supply a refrigerant to the indoor unit.

Meanwhile, the air conditioner may be implemented to control an indoor unit and an outdoor unit independently. In the conventional air conditioner, at least one indoor unit may be connected to the outdoor unit. Based on a requested operational state, the air conditioner may be operated in a cooling or heating operation for supplying refrigerated or heated air.

In a conventional process for controlling the cooling or heating mode, the indoor unit may be configured to sense room temperatures and adjust a cooling or heating level based on the sensed room temperature. However, the indoor unit according to such prior art has to be constantly operated such that such the prior art cannot provide a power saving function.

Accordingly, the present disclosure may suggest a solution for saving power while the indoor unit and the outdoor unit check room temperatures and operate based on the room temperature.

DETAILED DESCRIPTION OF INVENTION

Technical Problems

Accordingly, an object of the present disclosure is to address the above-noted and other problems and provide a learning-based air conditioning device configured to operate based on sensed temperature or humidity change after sensing temperature or humidity change in a suspended section of an air conditioner, and a method of implementing the device.

An object of the present disclosure is to provide an air conditioning device configured to calculate an optimal operation mode that may be applicable when an air conditioner is re-operated after paused based on a learning factor of a sensed value calculated by an indoor unit provided in each of air conditioning devices, and a method of implementing the same.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Technical Solution

Embodiments of the present disclosure may provide an air conditioner for predicting air conditioning load based on room temperature change including a sensor configured sense a room temperature or humidity in a suspended section in which the air discharge part is not operated; and a central controller implemented to control the air discharge part and the outdoor unit based on operation mode information calculated from the value sensed by the sensor, when the air discharge part and the outdoor unit are switched on.

The air conditioner according to one embodiment may calculate operation mode information that instructs standard load for operating the air conditioner with the same load as first load for a section prior to the suspended section, or light load for operating the air conditioner with a lighter load than the first load, or overload for operating the air conditioner with a heavier load than the first load.

The central controller of the air conditioner according to one embodiment may control the air discharge part and the outdoor unit in the second operation section based on the operation mode information that is calculated during the suspended section based on the value sensed by the sensor during the first operation section.

In another aspect, a method of predicting air conditioning load based on room temperature change may include controlling a sensor of an air conditioner to sense a room temperature or humidity in a suspended section in which an air discharge part of the air conditioner is not operated; and implementing a central controller to control the air discharge part and the outdoor unit based on operation mode information that is calculated from the value sensed by the sensor, when the air discharge part and the outdoor unit of the air conditioner are switched on.

Advantageous Effect

When applying embodiments, the air conditioner according to the embodiments of the present disclosure, the air conditioner may sense room temperature or humidity change in a suspended section after the operation and calculate a corresponding operation mode based on the temperature or humidity change as a learning factor.

In addition, when applying the embodiments, a cloud server may calculate a proper operation mode when each of the air conditioners are re-operated after being off, based on a sensed value provided after calculated by the air conditioners.

Effects are not limited to the effects mentioned above, and one having ordinary skill in the art can readily draw various effects from the configurations in the disclosure.

DETAILED DESCRIPTION OF EXEMPLARY EMBODIMENT

Figure 1:
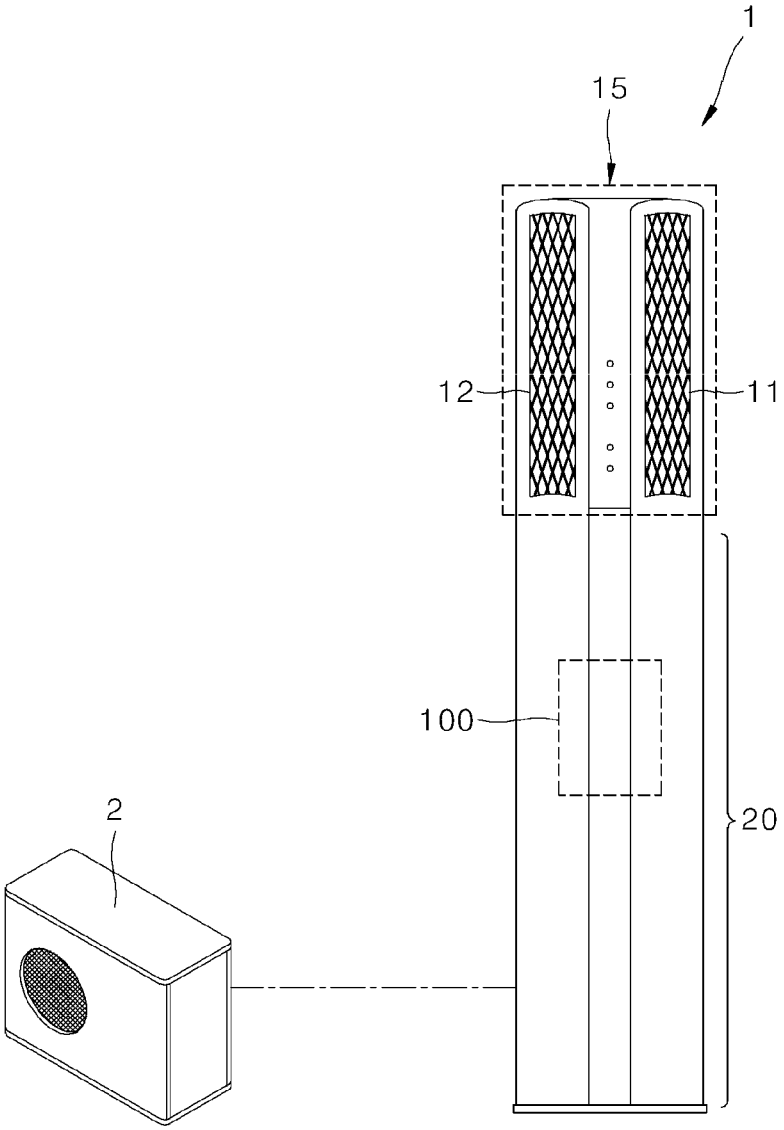
FIG. 1 is a front view illustrating a configuration of an indoor unit provided in an air conditioner according to one embodiment of the present disclosure.

Hereinafter, embodiments in the disclosure are described in detail with reference to the accompanying drawings such that the embodiments can be easily implemented by those skilled in the art. The subject matter of the disclosure can be implemented in various different forms and is not limited to the embodiments set forth herein.

For clarity in description, details which are not associated with the description are omitted, and throughout the disclosure, the same or similar components are referred to by the same reference signs. Some embodiments in the disclosure are described in detail with reference to the accompanying drawings. In the drawings, the same components are referred to by the same reference numeral as possible. In the disclosure, detailed descriptions of known technologies in relation to the disclosure are omitted if they are deemed to make the gist of the disclosure unnecessarily vague.

Terms such as first, second, A, B, (a), (b), and the like can be used to describe components of the disclosure. These terms are used only to distinguish one component from another component, and the essence, order, sequence, number, or the like of the components is not limited by the terms. When a component is "connected", "coupled" or "linked" to another component, the component can be directly coupled or connected to another component, or still another component can be "interposed" therebetween or the components can be "connected", "coupled" or "linked" to each other with still another component interposed therebetween.

In implementing the subject matter of the disclosure, components can be segmented and described for convenience of description. However, these components can be implemented in one device or module, or one component can be divided and implemented into two or more devices or modules.

In the present disclosure, an outdoor unit and an indoor unit may be provided as components composing an air conditioner. One air conditioning system may be configured of one or more outdoor unit and one or more indoor units. A relation between the outdoor unit and the indoor unit may be 1:1, 1:N or M:1.

Embodiments of the present disclosure may be applicable to all types of devices configured to control cooling or heating. For convenience of description, embodiments of the present disclosure focus on cooling. In case of being applied to the heating, embodiments of the present disclosure may be applied to a process for raising temperatures or a mechanism for keeping the raised temperature.

FIG. 1 is a front view illustrating a configuration of an indoor unit provided in an air conditioner according to one embodiment of the present disclosure.

The indoor unit of the air conditioner may be categorized into a ceiling-mount type or stand type. Or, it may be categorized into a wall-mount type mounted on a wall or a movable type. FIG. 1 shows a stand type indoor unit 1 among such various types but embodiments of the present disclosure are not limited thereto. The indoor unit 1 may be connected to an outdoor that is arranged in an additional space.

The air conditioner may be configured of a stand type air conditioning system that stands indoors that is an object of air conditioning. In this instance, the air conditioning system may further include a base 20 put on the bottom of the room to support an air conditioning module 15.

The air conditioning module 15 may be installed on the base 20 such that it may suck air and condition the air at a certain height.

The air conditioning module 15 may be detachably coupled to the base 20. Or, it may be integrally formed with the base 20 as one body.

Air discharge part 11 and 12 composing the air conditioning module 15 may be configured to discharge air. The air discharge part 11 and 12 may discharge air from a front intensively. Based on various embodiments, air may be discharged from air outlets that are arranged in lateral surfaces or an upper surface in several directions. The air discharge part 11 and 12 may control a wind speed based on control of a control module 100. In one embodiment, the air discharge part 11 and 12 may be configured to discharge wind at multiple steps of speeds and control one or more blow fans independently.

Specifically, the air discharge part 11 and 12 may discharge the air supplied from the outdoor unit 2 as wind and intake indoor air. Although not visible outside, a control module 100 may be disposed in the indoor unit 1 and configured to control the indoor unit 1. For convenience of description, FIG. 1 shows that the control module is marked with a dotted line to indicate that the control module 100 is disposed in the indoor unit 1.

The outdoor unit 2 may control a temperature of the air (wind) discharged from the air discharge part 11 and 12. As one example, a compressor of the outdoor unit 2 may compress a gas refrigerant into a high-temperature-and-high-pressure gas to discharge a cooled air to the indoor unit 1. The outdoor unit 2 may also supply heated air to the indoor unit by means of a preset heat pump. There are suggested diverse methods in which the outdoor unit 2 supplies the cooled or heated air to the indoor unit 1 and embodiments of the present disclosure are not limited thereto.

The indoor unit 1 shown in FIG. 1 as one example may measure a room air condition and operate for the measured room air condition to reach a preset state. However, various factors before and after a preset state needs to be reflected to operate the indoor unit efficiently during the process for raising a room air condition to a preset state. The operation of the indoor unit may be controlled more precisely by means of a learning model implemented based on such various factors, such that efficient operation of the indoor unit may be facilitated.

Hereinafter there may be described one embodiment for implementing room load determination when the air conditioner is powered off besides load determination in a cooling and heating mode. Hence, the air conditioner may predict heating or cooling load based on room temperature change in a power-off state and change a quick heating/cooling mode into a normal mode. A technical feature for implementing power saving control during the changing a quick mode into a normal mode will be described.

Especially, according to embodiments of the present disclosure, room load may be predicted in a power off state to facilitate an efficient operation of the air conditioner. A control module 100 may control the outdoor unit based on the predicted cooling or heating load.

In the detailed description, the term of "Off" means a state that cooled air or heated air is not discharged from the air conditioner.

Or, the term of "Off" means a condition that the air conditioner operates only an air discharge function, without performing a cooled/heated air discharge function for raising or lowering a room temperature.

When an indoor unit 1 is off state, the control module 100 may sense temperature change and determine the cooling load or heating load that will be provided by the indoor unit 1, when the indoor unit 1 re-starts, based on the magnitude of the temperature change or temperature change per hour.

According to another embodiment, the control module 100 may transmit the sensed temperature change to an external cloud server after sensing temperature change. The cloud server may determine the cooling or heating load the indoor unit 1 will supply when it re-operates based on the magnitude of the temperature change or the temperature change per hour. When the cloud server may transmit the result of the determination to the control module 100, the control module 100 may control the indoor unit 1 and the outdoor unit 2 based on the result.

Figure 2:
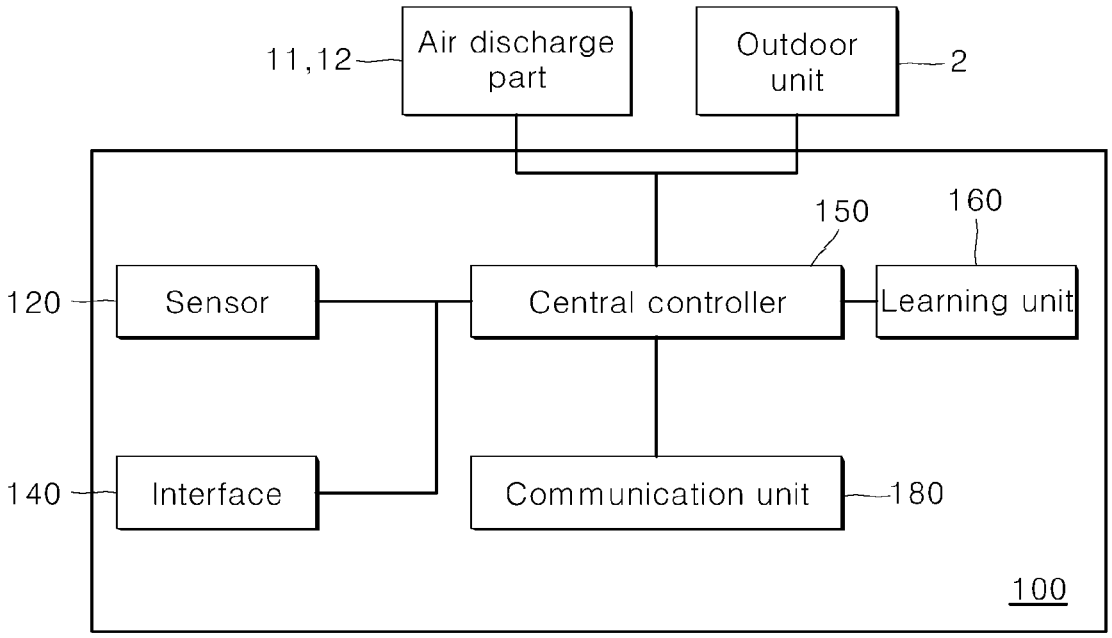
FIG. 2 is a diagram illustrating a configuration of a control module according to one embodiment of the present disclosure.

FIG. 2 is a diagram illustrating a configuration of the control module according to one embodiment of the present disclosure. According to the configuration shown in FIG. 2, the control module 100 may learn room temperature change even when the air conditioner is powered off and determine cooling/heating load so as to efficiently control the cooling or heating based on the result of the room load even when the air conditioner is powered on again after that.

The sensor 120 may sense temperatures, humidity or sizes of room space. The sensor 120 may be configured to continuously sense temperatures and humidity at a preset time interval.

The room size may be sensed based on temperature change, wave transmission and reverb of the sound wave transmission. It may be sensed based on drawing information about the location where the air conditioner is installed. Or, the room size may be sensed by means of a camera installed in an upper end of the air conditioner.

A value sensed by the sensor 120 may be transmitted to a central controller 150 and the central controller 150 may transmit the sensed information to a learning unit 160. The central controller may include a processor configured to implement instructions.

The learning unit 160 may receive an input of the transmitted temperature and humidity or change values of them and determine load at the time of the air conditioner operation based on the input value. For example, the learning unit may calculate values of overload/standard load/light load.

The values input to the learning unit 160 may include a room temperature, a target temperature, and a temperature change rate by time interval. A time interval from the time of the air conditioner operation start to the time after being off may be divided into predetermined ranges. The values may also include information on the load determined at each time interval of the ranges. In other words, the learning unit 160 may repeatedly determine the load and calculate needed load at the present time based on an input of the determination result at the prior time interval.

The value input to the learning unit 160 may be values that are sensed by the sensor 120 or a preset representative value that is generated after the sensed values accumulate in a memory of the central controller 150. For example, such a representative value may be a mean, a mode, a minimum, a maximum.

The learning unit 160 may direct the output to an operation mode. The operation mode information may indicate a load degree when the air conditioner is operating. Such the operation mode may be categorized into overload, standard load and light load or an air volume or a wind speed may compose the operation mode information.

In addition, the sensor 120 may check temperature or humidity change at the time when the air conditioner operation is off or for a preset time interval after the operation off. Hence, the sensor 120 may transmit the checked change to the central controller 150.

The central controller 150 may accumulate the information transmitted from the sensor 120 and input the accumulative storage of the information to the learning unit 160. After that, the learning unit 160 may control the air conditioner based on the output result of the information. The central controller 150 may be configured to control the indoor unit 1 or the outdoor unit 2.

An interface 140 may be configured to allow a user to control the temperature, humidity, air volume or wind direction of the indoor unit 1. The interface 140 may be a button type or a remote control type. Also, the interface 140 may receive an interrupt signal for changing the speed, volume or temperature of the air discharged from the air discharge part 11 and 12. The interrupt input may be stored in the learning unit 160 as certain information.

A communication unit 180 may transceive data with the cloud server. The communication unit may transmit the representative value calculated based on the values sensed by the sensor 120 or by the central controller 150 to the cloud server. The communication unit 180 may transmit the operation mode information calculated by the learning unit 160, corresponding to the representative value. Or, the communication unit 180 may transmit the interrupt input that is input via the interface 140 to the cloud server.

Meanwhile, the communication unit 180 may receive preset information configured to update or upgrade the learning unit 160 from the cloud server.

The central controller 150 may control the indoor unit 1 and the outdoor unit 2 based on the operation mode information calculated by the learning unit 160.

Figure 3:
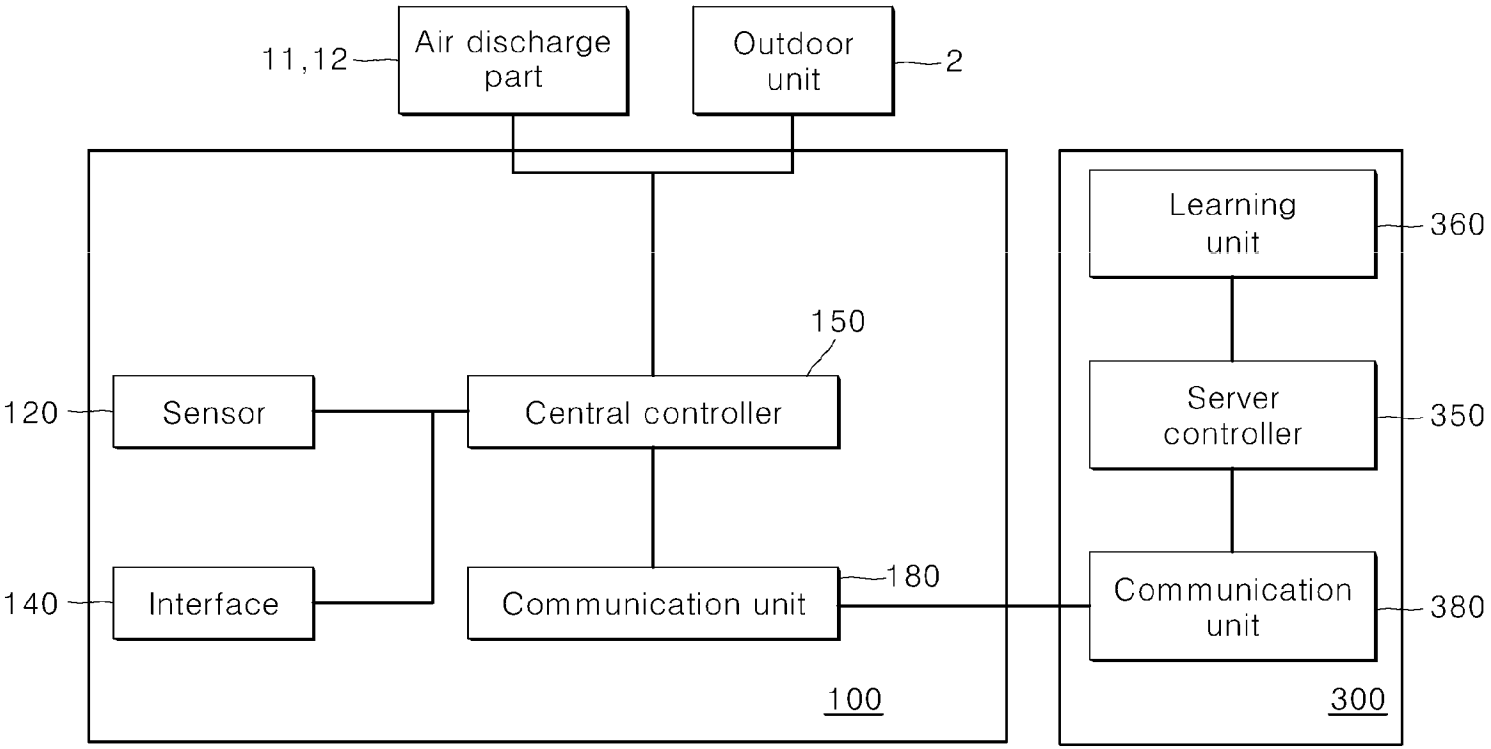
FIG. 3 is a diagram illustrating a configuration of a control module according to another embodiment of the present disclosure.

FIG. 3 shows a configuration of a control module according to another embodiment.

According to the configuration shown in FIG. 3, the cloud server 300 may learn room temperature change during the operation of the air conditioner provided as a cooler or heater and determine cooling or heating load based on the learned room temperature change. The control module 100 may sense the room temperature change even when the air conditioner is off and transmit the result of the sensing to the cloud server 300.

After determining the room load, the cloud server 300 may calculate the operation mode information used to efficiently control the cooling or heating even when the air conditioner operates, based on the result of the determination and then transmit the operation mode information to the control module 100.

The sensor 120 shown in FIG. 3 may be corresponding to the sensor 120 shown in FIG. 2. The central controller 150 may be provided with the value sensed by the sensor 120 and transmit the value to the cloud server 300 via the communication unit 180.

The cloud server 300 may include a servo controller 350, a learning unit 360 and a communication unit 380. The learning unit 360 provided in the cloud server 300 may receive inputs of the temperatures or humidity transmitted by air conditioners or change value thereof, and determine room load at the point of the air conditioner operation after that based on the input of the values. For example, the learning unit 360 may calculate values of overload, standard load and light load.

The values input to the learning unit 360 may include a room temperature, a target temperature, and a temperature change rate by time interval. A time interval from the time of the air conditioner operation start to the time after being off may be divided into predetermined ranges. The values may also include information on the load determined at each time interval of the ranges. In other words, the learning unit 360 may repeatedly determine the load and calculate needed load at the present time based on an input of the determination result at the prior time interval.

The value input to the learning unit 360 may be values that are sensed by the sensor 120 or a preset representative value that is generated after the sensed values accumulate in a memory of the central controller 150. For example, such a representative value may be a mean, a mode, a minimum, a maximum.

The learning unit 360 may direct the output to an operation mode. The operation mode information may indicate a load degree when the air conditioner is operating. Such the operation mode may be categorized into overload, standard load and light load or an air volume or a wind speed may compose the operation mode information.

In addition, the sensor 120 may check temperature or humidity change at the time when the air conditioner operation is off or for a preset time interval after the operation off. Hence, the sensor 120 may transmit the checked change to the central controller 150.

The central controller 150 may accumulate the information transmitted from the sensor 120 and the communication unit 180 may transmit the stored value to the cloud server 300. After input the transmitted value, the learning unit 360 of the cloud server 300 may transmit the output result (the operation mode information) to the communication unit 180 of the air conditioner again.

Hence, the central controller 150 may control the air conditioner based on the operation mode information calculated by the cloud server 300. The central controller 150 may control the indoor unit 1 or the outdoor unit 2.

An interface 140 may be equal to the interface described in the embodiment shown in FIG. 2.

A communication unit 180 may transceive data with the cloud server. The communication unit may transmit the values sensed by the sensor 120 or representative value calculated by the central controller 150 based on the sensed values to the cloud server. Or, the communication unit 180 may transmit the interrupt input that is input via the interface 140 to the cloud server.

Meanwhile, the communication unit 180 may receive the operation mode information calculated by the learning unit 360 of the cloud server 300 and the central controller 150 may control the indoor unit 1 and the outdoor unit 2 based on the received operation mode information.

The learning unit 160 and 360 shown in FIGS. 2 and 3 may output the operation mode of the air conditioner based on input values. The operation mode information calculated by the learning unit 160 and 360 may instruct load when the air conditioner re-operates after being off.

Figure 4:
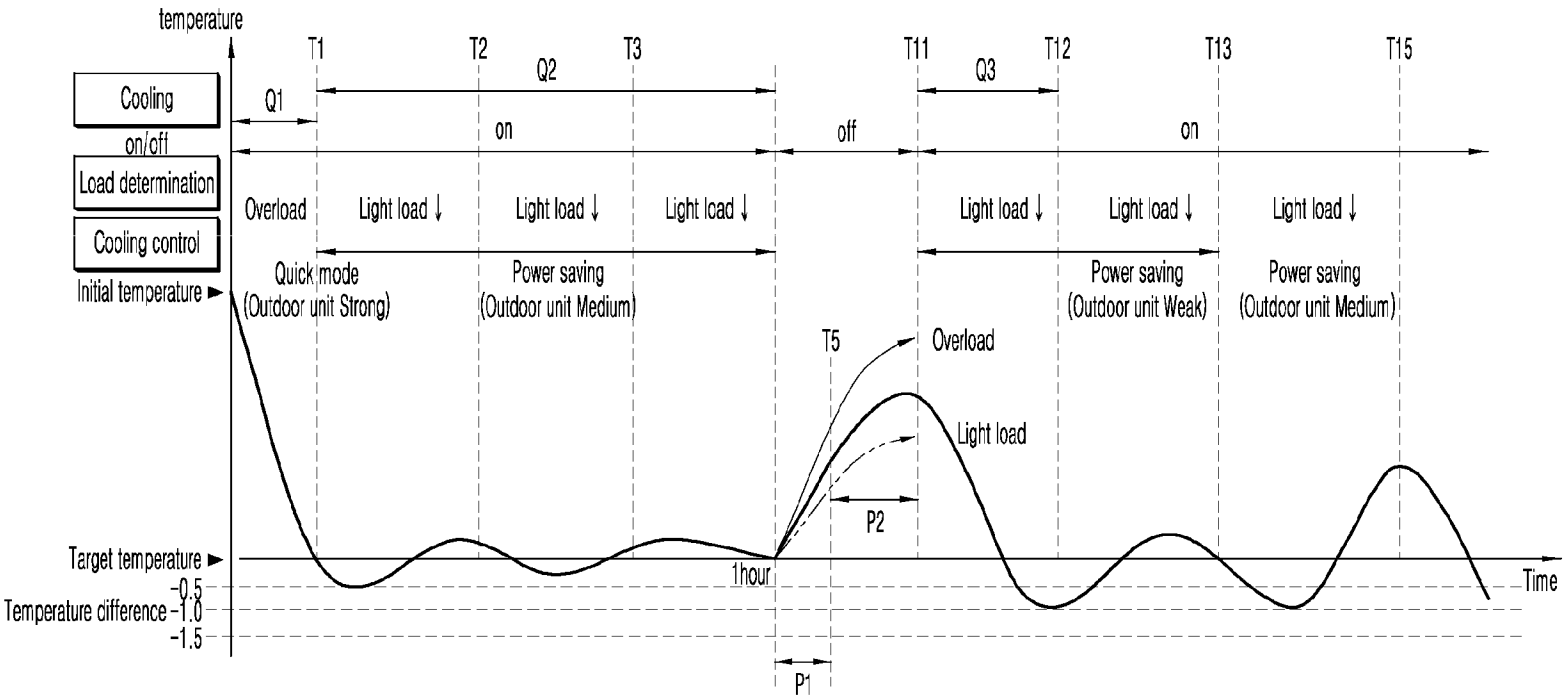
FIG. 4 is a diagram illustrating that a cooling temperature is controlled according to one embodiment of the present disclosure.

FIG. 4 shows a process for controlling a cooling temperature according to one embodiment of the present disclosure. FIG. 4 shows an exemplary embodiment of cooler, however, the embodiment may be applied to heater, except a direction of a temperature.

A first operation section shown in FIG. 4 is Q1 and Q2. A suspended section is P1 and P2 that is marked "Off". A second operation section is a section after T11.

The control module 100 shown in FIG. 2 or the control module 100-cloud server 300 shown in FIG. 3 may control the learning unit 160 and 360 to perform load determination based on room temperature change during the operation of the air conditioner. In addition, the learning unit 160 and 360 may perform the room load determination to control efficient cooling.

A target temperature may be a room temperature set in the air conditioner operated in the cooling operation or the heating operation. The air conditioner in the cooling operation or the heating operation may be configured to pause the operation or reduce cooling or heating load, when the room temperature reaches a target temperature. Such a target temperature may be preset by the user. Alternatively, even unless the user presets a target temperature, the air conditioner may collect information about the current outside temperature and the room temperature and set a target temperature based on the collected information.

An initial temperature may mean a room temperature when the air conditioner starts to operate. Cooling control may mean the operation of the air conditioner. The cooling control may indicate a quick operation, a power saving operation, that are operational state of the outdoor unit (e.g., a strong mode, an intermediate mode and a weak mode).

Load determination may mean the result of the load performed based on room temperature change by the learning unit 160 and 360 provided in the control module 100 of FIG. 2 or the control module 100—the cloud server 300 of FIG. 3. Load levels may be preset based on the performance of the air conditioner. Such load levels may be configured of a light load level, a standard load level and an over load level. Or, the load levels may be configured of a first load, a second load, a third load, a fourth load and a fifth load.

Cooling On/Off may mean a state where the indoor unit of the air conditioner is switched on or off.

In FIG. 4, the air conditioner is continuously operated in a quick mode from the start of the operation, until the room temperature reaches a target temperature. The quick mode is a preset mode of the air conditioner that is configured to reach a room temperature to a target temperature by operating the air conditioner with high power. In the quick mode, electrical energy usage may be higher than other modes. As shown in FIG. 4, an operational state of the outdoor unit is set to "Strong" in the quick mode. The air conditioner is operated as overload After the room temperature reaches the target temperature (Q2), the air conditioner may be operated in a power saving mode and the operational state of the outdoor unit may be set to "Intermediate". In Q2, the air conditioner may be operated as light load.

Specifically, the learning unit 160 and 360 may perform load determination at time of t1 that is a start section of Q2 based on temperature or humidity change, an initial temperature, a target temperature, an initial temperature change rate, a temperature change rate during Section Q1, time that is taken to reach the target temperature and the like.

The information collected while the air conditioner is operated based on the load determined at time T1 may be input to the learning unit 160 and 360. Then, the learning unit 160 and 360 may perform load determination at T2 again. At this time, to determine load, the learning unit 160 and 360 may receive information including a temperature at T1, a target temperature, a temperature change rate, a temperature change rage in +a range with respect to the target temperature, space size and the like.

The information collected while the air conditioner is operated based on the load determined at T2 may be input to the learning unit 160 and 360. The learning unit 160 and 360 may perform load determination again and the air conditioner may start operation after T3.

Hence, the air conditioner may be switched off in a suspended section. The suspended section is a section where the air discharge part 11 and 12 pauses the operation.

The learning unit 160 and 360 provided in control module 100 of FIG. 2 or the cloud server 300 of FIG. 3 may perform load determination for the room in a preset time period P1. For example, once the air conditioner for the cooling operation is off, the room temperature may rise. Once the air conditioner for the heating operation is off, the room temperature may fall.

P1 time is a time period when operation mode information is calculated. P1 may be a specific time after a preset time period from the point when the air discharge part pauses the operation.

An operation state of the outdoor unit when the air conditioner starts the operation again may be set to Strong, Intermediate and Weak mode based on a range of rising or falling temperatures in the room. To control the operation of the indoor unit and the outdoor unit, the learning unit 160 and 360 may check temperature change during section P2 after a preset time period P1 and calculate the result of the over load, standard load or light load based on the sensed temperature change. After that, the control module 100 may control load from the start point T11 of Q3 based on the calculated result and implement the operation of the indoor unit and the outdoor unit.

Specifically, P1 section is a time period when room air slowly changes after the air conditioner is off. The length of P1 may be variable by reflecting characteristics of the air conditioner, operational characteristics during former section Q1/Q2, or duration time or temperature change of Q1/Q2. Alternatively, P1 may be a preset fixed time length.

After section P1, the sensor 120 of the air conditioner may sense room temperature or humidity at time T5. When the temperature rises or falls based on the result of the sensing, information including the width or speed of the temperature rise or the time taken to raise the room temperature to a preset specific temperature may be calculated.

The calculated information may be input to the learning unit 160 or 360 provided in the control module 100 of FIG. 2 or the the cloud server 300 of FIG. 3. The learning unit 160 and 360 may receive information that is sensed in T5 or information sensed during P2 after T5 and information determined in prior T1, T2 and T3, and perform load determination when the air conditioner is on after that.

When the air conditioner is on after that (the point when Q3 starts, T11), the controller 10 may apply light load, standard load or over load of the air conditioner to control the indoor unit and the outdoor unit.

Operation mode information may instruct a standard load mode configured to operate the air conditioner with the same load as a first load before the suspended section or a light load mode configured to the operate the air conditioner with a lighter load that is lighter than the first load or an over load mode configured to operate the air conditioner with an over load that is heavier than the first load. Here, the first load may be load after T3 or T2 or load T1 as one example.

The over load may mean a mode configured to operate the outdoor unit at full performance. Or, the overload mode may mean a mode configured to operate the outdoor unit to use more electric energy than the preset operation performance of the outdoor unit.

The standard load may mean a mode configured to operate the outdoor unit at medium performance. Or, the standard load may mean a mode configured to operate the outdoor unit to use the same sized electric energy as the preset operation performance of the outdoor unit.

The light load may mean a mode configured to operate the outdoor unit at minimal performance. Or, the light load may mean a mode configured to operate the outdoor unit to use less electric energy than the operation performance of the outdoor unit.

FIG. 4 shows a first operation section Q1 and Q2, a suspended section P1 and P2, a second operation section (after T11). The central controller 150 may control the calculation of the operation mode information at a specific point of the suspended section by using the value sensed by the sensor 120 during the first operation section. Hence, the central controller 150 may control the air discharge part and the outdoor unit based on the calculated operation mode information calculated in the second operation section.

In one embodiment, the operation mode information may be inversely proportional to a temperature difference between the temperature at a start point and an end point of the first operation section.

For example, the difference between the temperature at the start point and the temperature at the end point of the first operation section could be big and it may mean that the room is a space in which the temperature can be changed rapidly when the air conditioner operates. In this instance, an operation mode configured to lower the electric energy size or the air discharge amount (e.g., a standard load mode or a light load mode) when cooled or heated air is discharged may be calculated in T11.

In contrast, when the difference between the temperature at a start point of Q1 and an end point of Q2 is little, it may mean that the room is a space in which the temperature is changed slowly when the air conditioner operates. In this instance, an operation mode configured to increase the electric energy size or the air discharge amount (e.g., a standard load mode or an over load mode) when cooled or heated air is discharged may be calculated in T11.

According to one embodiment, the operation mode information may be proportional to a temporal size of the first operation section.

For example, when a temporal length from a start point of Q1 to an end point of Q2 is short, it may mean the room is a space in which the temperature is changed rapidly even when the user operates the air conditioner for a short time. In this instance, an operation mode configured to lower the electric energy size or the air discharge amount (e.g., a standard load mode or a light load mode) when cooled or heated air is discharged may be calculated in T11.

In contrast, when the temporal length from the start point of Q1 to the end point of Q2 is long, it may mean the room is a space in which the temperature is changed when the user has to operate the air conditioner for a long time. In this instance, an operation mode configured to increase the electric energy size or the air discharge amount (e.g., a standard load mode or an over load mode) when cooled or heated air is discharged may be calculated in T11.

Unless the air conditioner is off even in a preset time period after the operation mode information is calculated in T5, the central controller 150 may calculate a new operation mode information.

When applying one embodiment of the present disclosure, load may be predicted based on temperature learning for a preset time period after the air conditioner operated in the cooling or heating mode may be off. When the air conditioner for cooling or heating after that, cooling or heating load at a point when the air conditioner for cooling or heating is on may be determined by reflecting sensed information in a prior section based on the result of the load determining point.

In this process, only the outdoor unit may be operated with standard load during section P2. For example, in the cooling operation, the outdoor unit may be operated with the standard load in an "Intermediate" state, while the indoor unit is off. When the air conditioner for the cooling is on, the time taken to provide cooled air for re-cooling may be shorter even if the load determined in P2 after light load is overload.

Meanwhile, the learning unit 160 and 360 may perform load determination at T12 and T13 even after section Q3. Even when the room temperature continuously rises even with the light load after T13, it may mean that external environmental factors are changed. In this instance, the learning unit 160 and 360 may perform load determination by reflecting the temperature rise after T13 and set the outdoor unit to "Intermediate" state.

Change of external environmental factors means that heat is supplied to the room during the cooling process. For example, it means that the window is open or cooking starts in the room. Such environments are likely to cause overload. Accordingly, the air conditioner may perform new load determination and be operated based on the new load determination.

In other words, the sensor 120 may sense room temperature or humidity in the suspended section (off) in which the air discharge part is not operated as shown FIG. 4. When the air discharge part and the outdoor unit is on (T11), the central controller 150 may control the air discharge part and the outdoor unit based on the operation mode information calculated from the value sensed by the sensor 120. At this time, the learning unit 160 of the control module 100 shown in the embodiment of FIG. 2 or the learning unit 360 of the cloud server 300 shown in the embodiment of FIG. 3 may calculate the operation mode information.

T5 shown in FIG. 4 is a calculation time of the operation mode information in the suspended section. The central controller 150 may determine a point of T5 based on the temperature at the end point of the first operation section or the temporal size of the first operation section.

For example, in one embodiment of the air conditioner operated in the cooling mode, the central controller 150 may increase a time point of T5, in other words, the length of P1 when the temperature is relatively very low at the end point of the first operation section. To reflect the characteristics of the temperature change in the suspended section in a state the room temperature is too low, the central controller 150 may increase the length of P1. In contrast, when the room temperature is relatively high, the central controller 150 in the air conditioner for the cooling operation according to one embodiment may decrease a time point of T5, in other words, the length of P1. To reflect the characteristics of the temperature change in the suspended section in a state the room temperature is too high, the central controller 150 may decrease the length of P1.

For example, in one embodiment of the air conditioner operated in the heating mode, the central controller 150 may increase a time point of T5, in other words, the length of P1 when the temperature is relatively very high at the end point of the first operation section. To reflect the characteristics of the temperature change in the suspended section in a state the room temperature is too high, the central controller 150 may increase the length of P1. In contrast, when the room temperature is relatively low, the central controller 150 in the air conditioner for the heating operation according to one embodiment may decrease a time point of T5, in other words, the length of P1. To reflect the characteristics of the temperature change in the suspended section in a state the room temperature is too low, the central controller 150 may decrease the length of P1.

When the temporal size of the first operation section is big (when the cooling or heating is performed for a relatively long time), the central controller 150 may increase a time point of T5, in other words, the length of P1. As the cooling or heating is performed for a long time, the central controller 150 may increase the length of P1 to reflect the temperature change characteristics in the suspended section.

In contrast, when the temporal size of the first operation section is short (when the cooling or heating is performed for a relatively short time), the central controller 150 may decrease a time point of T5, in other words, the length of P1. As the cooling or heating is performed for a short time, the central controller 150 may decrease the length of P1 to reflect the temperature change characteristics in the suspended section.

Figure 5:
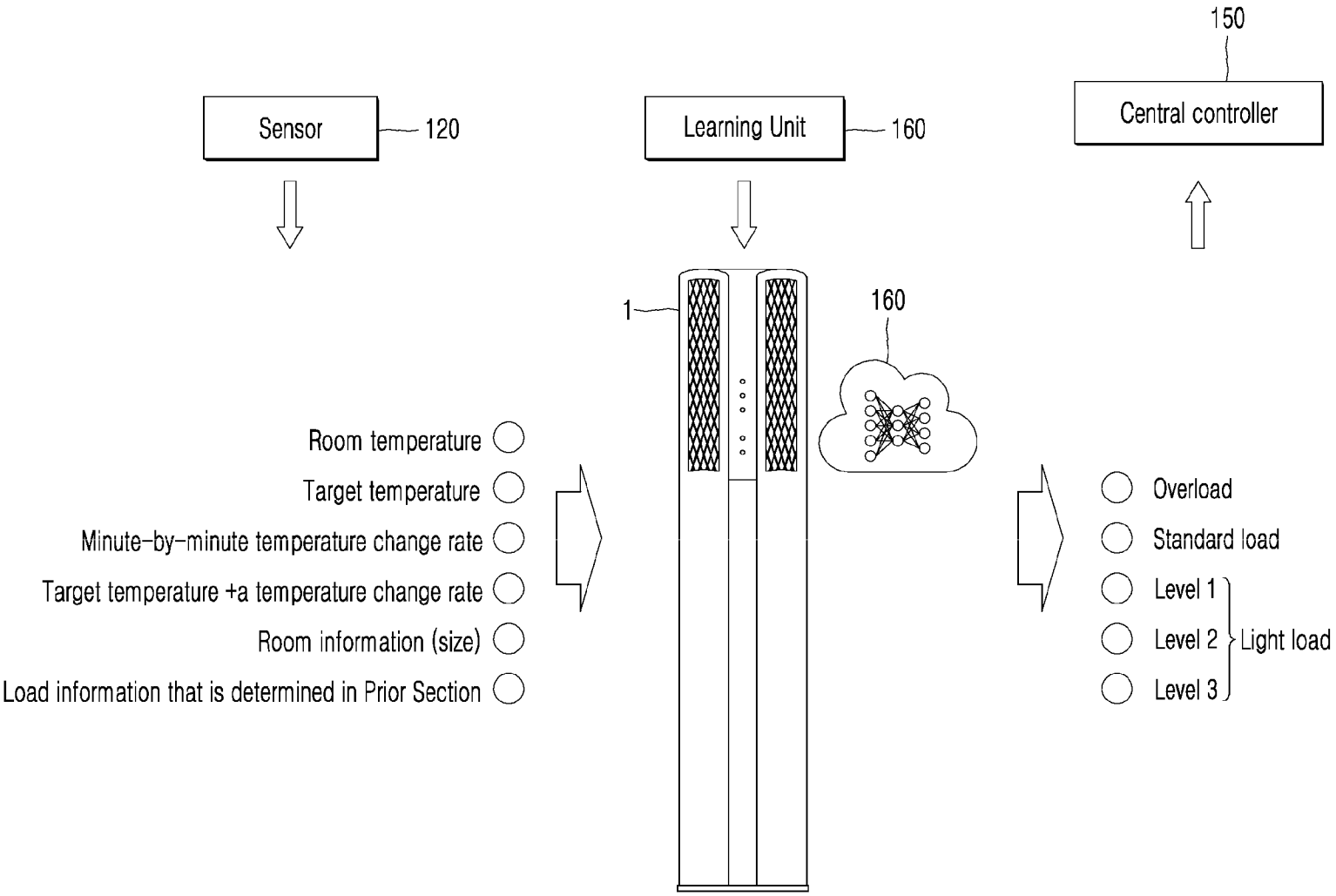
FIG. 5 is a diagram illustrating that a control module is implemented in the configuration shown in FIG. 2 according to one embodiment of the present disclosure.

FIG. 5 shows that the controller is implemented in the configuration shown in the embodiment of FIG. 2. Description of FIG. 5 is made together with the configuration of FIG. 2. When the central controller 150 provided in the control module 100 of indoor unit 1 processes the result sensing from the sensor 120 and inputs the result to the learning unit 160, the learning unit 160 may determine the load that is applied to operate the indoor unit 1 in the next section, corresponding to the input information.

At a preset specific point (e.g., an operation start point, T1, T2, T3, T11, T12, T13, and T15), the sensor 120 may sense room temperature, target temperature, minute-by-minute temperature (or 2-minute temperature), a temperature change rate, a temperature change rate to a preset value (+a) or more than target temperature, room information (or size), or load information that is determined in the prior section. One or more of them may be input to the learning unit 160.

The learning unit 160 may be configured of a deep learning module that completed learning. The learning unit 160 may output the next operation mode information to be one of the overload, standard load and light load modes, corresponding to the input. Especially, in the light load mode, load may be output at level 1, level 2 and level 3 to perform power-saving operation.

The central controller 150 may control the outdoor unit 2 and the air discharge part 11 and 12 based on the calculated operation mode information. The operation of the outdoor unit provided in the air conditioner may be determined based on the operational state (e.g., a high, middle or low state) and the operation of the air discharge part 11 and 12 may be determined based on air blowing strength.

Figure 6:
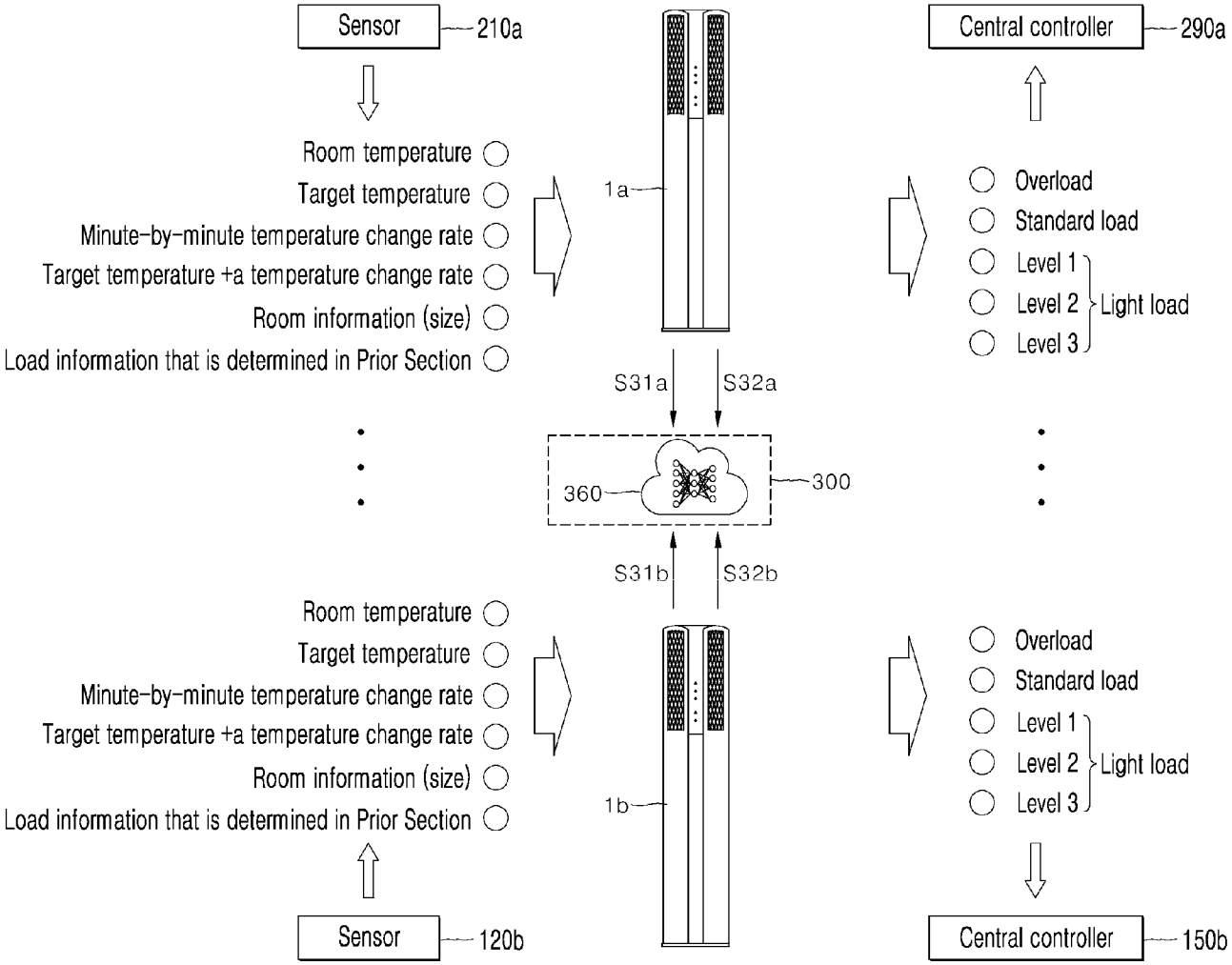
FIG. 6 is a diagram illustrating that a control module is implemented in the configuration shown in FIG. 3 according to another embodiment of the present disclosure.

FIG. 6 shows that the controller having the configuration of FIG. 3 is implemented according to another embodiment. The configuration of FIG. 6 is described together with the configuration of FIG. 3.

The central controller 150 may process the result of the sensing sensed by the sensors 120*a* and 120*b* provided in a plurality of indoor units 1*a* and 1*b*, respectively, and transmit the processed information to the cloud server 300 (S31*a*, S31*b*). Hence, the transmitted value may be input to the learning unit 360 and the learning unit 360 may determine the load applied to the operation of the indoor units 1*a* and 1*b* of the air conditioner in the next section based on the input information.

The learning unit 360 may be configured of a deep learning module that completed learning. The learning unit 360 may output the next operation mode information to be one of the overload, standard load and light load modes, corresponding to the input. Especially, in the light load mode, load may be output at level 1, level 2 and level 3 to perform power-saving operation.

The cloud server 300 may transmit the calculated operation mode information to corresponding indoor unit 1*a* and 1*b* (S32*a*, S32*b*). The central controller 150 of the control module 100 provided in each of the indoor units may control the air discharge part 11 and 12 of the outdoor unit 2 based on the calculated operation mode information.

In FIGS. 5 and 6, room temperature change or room humidity change may be sensed even while the air conditioner is off, to precisely predict load of an operation mode that will be implemented after the air conditioner is off. Then, the sensed information may be input to the learning unit 160 and 360 and the corresponding operation mode information may be calculated.

The learning unit 160 and 360 may be learned in advance. Alternatively, the learning unit 160 shown in FIG. 5 may perform learning based on the values sensed while the operation mode (e.g., the overload, the standard load and the light load) in the corresponding room is performed. Also, the learning unit 360 shown in FIG. 6 may perform learning based on the values sensed by the plurality of the air conditioners.

As another example, the cloud server 300 may periodically perform learning and transmit a preset program or file for upgrading the learning unit 160 provided in each control module 100.

The learning unit 160 or 360 of FIG. 5 or 6 may perform load determination by a specific point in time while the air conditioner is operated.

Accordingly, the learning unit 160 and 360 may perform load determination based on room temperature and a temperature change rate even in an initial cooling (heating) section. In this instance, load determination for a section after the room temperature reaches a target temperature (Section Q2) may be performed.

In addition, the learning unit 160 and 360 may perform load determination even in a state where the operation of the air condition is paused (P1 and P2), such that load determination information even in a point when the cooling re-starts (T11) may be secured. Accordingly, the air conditioner may be operated based on the load information and it may be operated according to temperature and humidity characteristics in the room even in Q3.

For example, unless there is no load determination for Section P2, the air condition that is switched on in T11 may have no information for the room and may not be operated in the quick operation.

However, when the embodiments of the present disclosure are applied, load determination may be performed in Section P2 and the air conditioner may be operated to properly fit the room state even in T11. In other words, according to the embodiment, it may be prevented that the air conditioner is operated in the quick operation mode, which consumes much electric energy, unconditionally after it is switched on.

In addition, load determination may be performed even during the operation of the air conditioner. Accordingly, the air conditioner may be operated by reflecting environmental condition change such as room temperature or humidity and room temperature/humidity change rate while the air conditioner is operated.

When the embodiments of the present disclosure are applied, load determination may be performed by learning of room temperature change during the operation of the air conditioner for cooling (or for heating) operated in the cooling operation (or the heating operation). In addition, room load determination may be performed even in a state where the air conditioner for cooling (or the air conditioner for heating) is off, such that the air conditioner may be efficiently operated even when it is powered on after that. Especially, the outdoor unit may be set to a standby state by reflecting the result of the load determination may be reflected even when the air conditioner for cooling (or the air conditioner for heating) is off, to reduce the time taken to raise the room temperature to a target temperature after the air conditioner is powered on.

According to the embodiments, the learning unit 160 and 360 may learn room environment change during the cooling or heating operation and room environment change after the cooling or heating is paused. Accordingly, the user may automatically implement cooling or heating control that is proper to load environment, without controlling the air conditioner additionally and electric energy save and comfortable cooling or heating may be provided.

Figure 7:
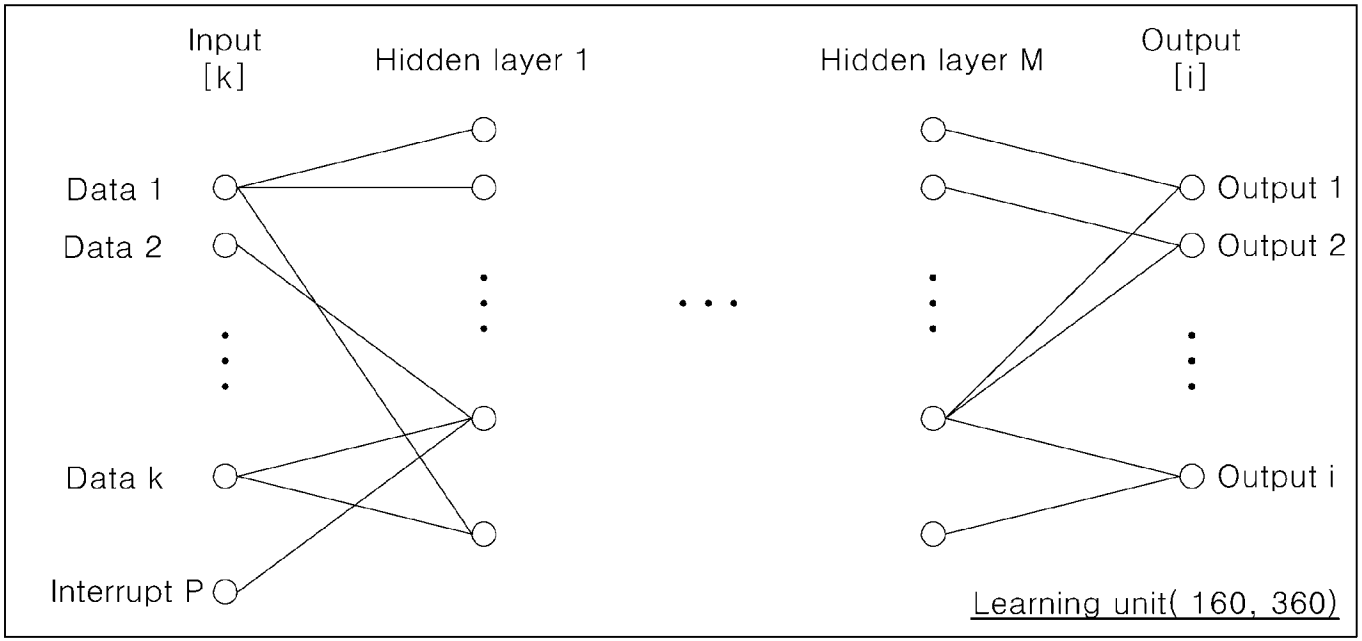
FIG. 7 is a diagram illustrating a configuration of a learning unit according to one embodiment of the present disclosure.

FIG. 7 shows a configuration of a learning unit according to one embodiment. The configuration of learning unit 160 and 300 shown in FIGS. 2 and 3 is described together.

The learning unit 160 and 360 may include an input layer configured of N data as input node; an output layer configured of operation mode information as output node; and one or more M hidden layers arranged between the input layer and the output layer.

As one example, the data may include the above-described room temperature and humidity, the room temperature change rate in a specific section, the load information determined in the prior section (the operation mode information), the room size and a change rate in case the room temperature rises or falls to a preset temperature range. However, the embodiments of the present disclosure may not be limited thereto.

In other words, a room temperature in the suspended section, a target temperature, a temperature change rate of temperatures rising or falling from the target temperature, a room size or load information that is determined in the prior art may be input to the input layer.

Here, a weight may be set on each edge connecting nodes of the layers with each other. The presence of the weight or edge may be added, deleted or updated during the learning process. Accordingly, the weights of the edges and the weights of the nodes arranged between the k input nodes and i input nodes may be updated by the learning process or interrupt input.

The i output nodes (i number of output nodes) may be arranged to output 1 and 0 or probability values for each mode. Or, one output node may be arranged and configured to output a factor that has to be relatively changed in a proper operation mode to control the outdoor unit (e.g., +, −, +10% and −20%).

Each of the nodes and edges may be set to an initial value before the learning performs learning. However, when information is accumulated and input, the weights of the nodes and edges shown in FIG. 7 may be changed. In this process, learning may be performed to re-set the node and the edge when the operation mode information implemented when the air conditioner is powered on after the suspended section, corresponding to the values sensed in the first section (Q1 and Q2) and the suspended section (Off) as shown FIG. 4, is set to the output mode.

Especially, when using the cloud server 300, the learning unit 360 may receive lots of data and perform learning based on the massive data at high speed.

The interrupt input means information that directs wind speed change or room temperature change that is input by the user after operation mode information for a proper operation mode is output. Accordingly, operation mode information for the suspended section after k data may be input in a prior operation section of the suspended section may be calculated and interrupt input is input after that. At this time, new operation mode information may be calculated by inputting a preset value to an auxiliary node (e.g., Interrupt P) or the learning unit 160 and 360 may be updated.

In short, the weights of the edges and nodes that are arranged between the input node and the output node of learning unit 160 and 360 of FIG. 7 may be updated during learning of the learning unit 160 and 360 or the interrupt input generated in the air conditioner.

In one embodiment shown in FIG. 7, Output 1 may be overload and Output 2 may be standard load. Output 3 may be light load-level 1, Output 4 may be light load-level 2, and Output 5 may be light load-level 3. The central controller 150 may control the outdoor unit in response to the overload, the standard load or the light load that are directed by the outputs.

The overload, the standard load and the light load may instruct the amount of the cooled or heated air generated through the outdoor unit and supplied to the room. Or, the overload, the stand load and the light load may instruct the temperature of the cooled or heated air. Also, they may instruct the size of the electric energy applied to the outdoor unit.

In addition, the overload, the standard and the light load may instruct the amount or speed of the wind discharged by the air discharge part.

In addition, the overload, the standard and the light load may instruct the operation of the outdoor unit or the air discharge part in the following steps based on the operation state of the outdoor unit or the air discharge part in the prior step.

"Output" shown in FIG. 7 may be one node and output only as a value. In this instance, the output value may {Overload|Standard load|Light load—Level 1|Light load—Level 2|Light load—Level 3} or {Overload|Standard load-|Light Load} or {Load level 1|Load level 2|Load level 3|Load level 4|Load level 5}. Those values may be variable or specified.

Once completing the operation, the air conditioner may keep an off-state. At this time, the sensor 120 may calculate room temperatures, room humidity or room temperature or humidity change rate at a specific point in time (T5 of FIG. 4) as a sensing point to determine a level of the cooling or heating load in the following operation section.

The calculated values may be various environmental factors (e.g., room temperature and room size) and they may be transmitted to the learning unit 160 or the cloud server 300, such that the learning unit 160 or the cloud server 300 may calculate operation mode information for instruct load determination (e.g., light load, standard load and overload).

Such environmental factors may be determined in various ways. As one example, the central controller 150 and the sensor 120 may sense and calculate one or more of the room temperature at a start point of the suspended section, a temperature set as a target (a target temperature), a temperature or humidity change rage for a preset section (a minute-by-minute or more time units) or an initial temperature change rate, the size of a room where the air conditioner is arranged, operation mode information that is applied to the determination or operation in the prior section. The learning unit (160 of FIG. 2 and 360 of FIG. 3) may receive inputs of the calculated information and calculate operation mode information based on the calculated information.

Figure 8:
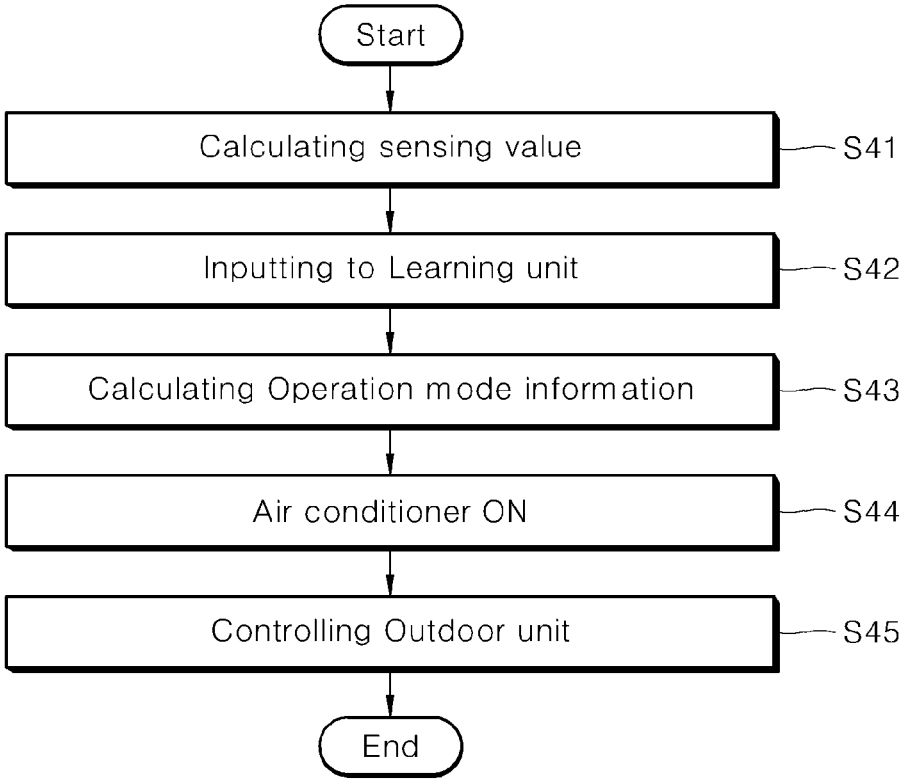
FIG. 8 is a diagram illustrating an operation process according to one embodiment of the present disclosure.

FIG. 8 shows an operation process according to one embodiment of the present disclosure. The sensor 120 may calculate a sensing value at T5 in the suspended section (S41). T5 may be variable based on characteristics of the temperature change or the cooling or heating time in the prior section (the first operation section).

The sensing value (including a change rate of the sensing value) may be input to the learning unit 160 (S42), and the learning unit 160 may presume the load and calculate the operation mode information (S43). The operation mode information calculated based on load calculation may be categorized into the overload/standard load/light load or load level 1/load level 2/load level 3/load level 4 as mentioned above. In addition, the light load may be more specifically classified into level 1/level 2/level 3.

Hence, when the air conditioner is switched on (S44), the central controller 150 may control the outdoor unit 2 based on the presumed load and the corresponding operation mode information (S45).

Figure 9:
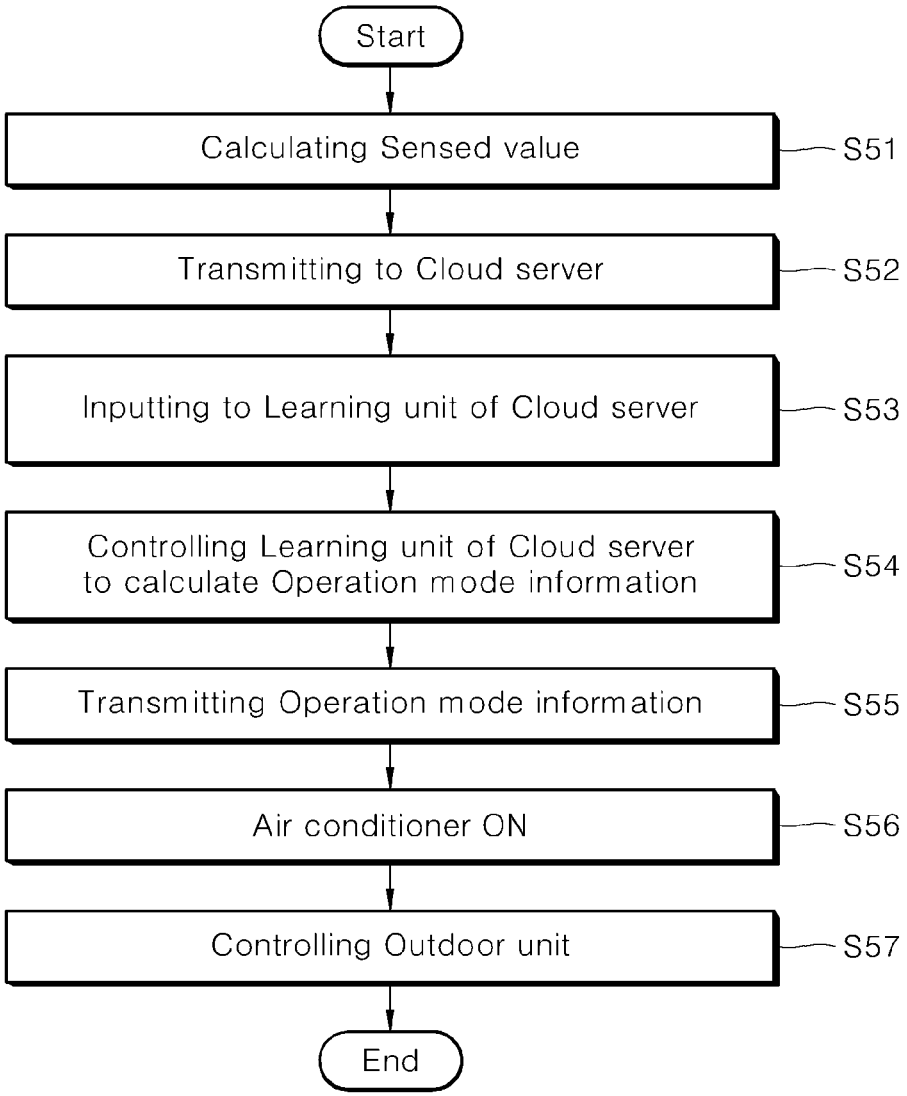
FIG. 9 is a diagram illustrating an operation process according to one embodiment of the present disclosure.

FIG. 9 shows an operation process according to one embodiment of the present disclosure. The sensor 120 may calculate a sensing value at T5 in the suspended section (S51). T5 may be variable based on the temperature change characteristics or the cooling or heating time characteristics of the prior section (the first operation section).

The sensing values (including a change rate of the sensing value) may be transmitted to the cloud server (S52), and the transmitted values may be input to the learning unit 360 of the cloud server (S53). The load may be presumed by the learning unit 360 and the operation mode information may be calculated (S54). The operation mode information based on the load presumption may be categorized into overload/standard load/light load or load level 1/load level 2/load level 3/load level 4. Also, the light load as mentioned above. In addition, the light load may be more specifically classified into level 1/level 2/level 3.

The calculated operation mode information may be transmitted to the air conditioner again (S55). When the air conditioner is switched on after that (S56), the central controller 150 may control the outdoor unit 2 based on the presumed load and the corresponding operation mode information (S57).

Even though all the components of the embodiments in the present disclosure are described as being combined into one component or operating in combination, embodiments are not limited to the embodiments set forth herein, and all the components can be selectively combined to operate within the scope of the purpose of the disclosure. All the components can be respectively implemented as an independent hardware, or some or all of the components can be selectively combined and can be embodied as a computer program including a program module that performs some or all functions combined into one or more hardwares. Codes or code segments of the computer program can be easily inferred by those skilled in the art. The computer program can be stored in a computer-readable recording medium and can be read and executed by a computer, whereby the embodiments in the disclosure can be realized. Examples of a storage medium of the computer program include storage mediums including a magnetic recording medium, an optical recording medium and a semiconductor recording element. The computer program for realizing the embodiments in the disclosure includes a program module which is transmitted via an external device in real time.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

What is claimed is:

1. An air conditioner for predicting air conditioning load based on room temperature change, the air conditioner comprising:

an outdoor unit;

an indoor unit including an air discharge part configured to discharge air;

a sensor configured to sense room temperature values during a suspended period in which the air discharge part is not operated; and a central controller implemented to control the air discharge part and the outdoor unit to operate based on operation mode information calculated from the room temperature values sensed by the sensor, wherein the operation mode information instructs the air conditioner to operate after the suspended period according to a standard load for operating the air conditioner with a same load as a first load incurred during a period prior to the suspended period, or a light load for operating the air conditioner with a lighter load than the first load, or a heavy load for operating the air conditioner with a heavier load than the first load, wherein a time point for calculating the operation mode information in the suspended period is a preset time period after a point when the air discharge part pauses operation, and wherein the time point is determined by the central controller based on the temperature when the air discharge part pauses operation.

2. The air conditioner of claim 1, further comprising a communication unit configured to transceive data with a cloud server, wherein the operation mode information is calculated by a learning unit provided in the cloud server, and wherein the communication unit is implemented to receive the operation mode information from the cloud server.

3. The air conditioner of claim 1, further comprising a learning unit provided in the air conditioner to calculate the operation mode information.

4. The air conditioner of claim 3, wherein the learning unit is implemented to receive an input of the sensed room temperature values or sensed room temperature value changes, and to output the operation mode information, wherein the learning unit comprises:

an input layer configured to receive an input value;

an output layer configured to output the operation mode information; and one or more hidden layers disposed between the input layer and the output layer, and wherein weights of nodes or edges between a node composing the input layer and a node composing the output layer are updated by a learning process of the learning unit.

5. The air conditioner of claim 4, wherein the input layer is implemented to receive inputs of a room temperature during the suspended period, a target temperature, a rate of room temperature rise or fall with respect to the target temperature, a room size, or load information.

6. The air conditioner of claim 1, wherein a first operation period in which the air discharge part and the outdoor unit are operated is performed prior to the suspended period, and a second operation period in which the air discharge part and the outdoor unit are operated is performed after the suspended period, and wherein the central controller is further implemented to control the air discharge part and the outdoor unit in the second operation period based on the operation mode information that is calculated during the suspended period based on the room temperature values sensed by the sensor during the first operation period.

7. The air conditioner of claim 6, wherein the central controller is further implemented to calculate the operation mode information that is inversely proportional to a difference between room temperature values at a start point of the first operation period and an end point of the first operation period, or to calculate the operation mode information that is proportional to a temporal size of the first operation period.

8. The air conditioner of claim 6, wherein the central controller is further implemented to determine a calculation point in time for the operation mode information based on a room temperature value at an end point of the first operation period, or to determine a calculation point in time for the operation mode information based on a temporal size of the first operation period.

9. The air conditioner of claim 6, further comprising a learning unit provided in the air conditioner to calculate the operation mode information, wherein the learning unit is implemented to receive an input of the sensed room temperature values or sensed room temperature value changes, and to output the operation mode information, wherein the learning unit comprises:

an input layer configured to receive an input value;

an output layer configured to output the operation mode information; and one or more hidden layers disposed between the input layer and the output layer, wherein weights of nodes or edges between a node composing the input layer and a node composing the output layer are updated by a learning process of the learning unit, and wherein the input layer is implemented to receive inputs of a room temperature during the suspended period, a target temperature, a rate of room temperature rise or fall with respect to the target temperature, a room size, or load information.

10. The air conditioner of claim 1, when the interrupt input for changing speed, volume or temperature of the air is input after the air conditioner is operated based on the operation mode information, then the central controller calculates new operation mode information using the interrupt input.

11. A method of predicting air conditioning load based on room temperature change, the method comprising:

controlling a sensor of an air conditioner to sense room temperature values during a suspended period in which an air discharge part of the air conditioner is not operated;

implementing a central controller to control the air discharge part and the outdoor unit to operate based on operation mode information calculated from the room temperature values sensed by the sensor;

instructing, with the operation mode information, the air conditioner to operate after the suspended period according to a standard load for operating the air conditioner with a same load as a first load incurred during a period prior to the suspended period, or a light load for operating the air conditioner with a lighter load than the first load, or a heavy load for operating the air conditioner with a heavier load than the first load; and calculating the operation mode information in the suspended period at a preset time period after a point when the air discharge part pauses operation, wherein the preset time period is determined by the central controller based on the temperature when the air discharge part pauses operation.

12. The method of claim 11, further comprising:

controlling a learning unit of a cloud server to calculate the operation mode information; and controlling the communication unit to receive the operation mode information from the cloud server.

13. The method of claim 11, further comprising controlling a learning unit of the air conditioner to calculate the operation mode information.

14. The method of claim 13, wherein the learning unit comprises an input layer configured to receive an input value, an output layer configured to output the operation mode information, and one or more hidden layers that are disposed between the input layer and the output layer, the method further comprising:

controlling the learning unit to receive an input of the sensed room temperature values or sensed room temperature value changes, and to output the operation mode information; and controlling the learning unit to update weights of nodes or edges between a node composing the input layer and a node composing the output layer during a learning process of the learning unit.

15. The method of claim 14, further comprising controlling the input layer to receive inputs of a room temperature during the suspended period, a target temperature, a rate of room temperature rise or fall with respect to the target temperature, a room size, or load information.

16. The method of claim 11, further comprising:

performing a first operation period in which the air discharge part and the outdoor unit are operated prior to the suspended period;

performing a second operation period in which the air discharge part and the outdoor unit are operated after the suspended period; and controlling the central controller to control the air discharge part and the outdoor unit in the second operation period based on the operation mode information that is calculated during the suspended period based on the room temperature values sensed by the sensor during the first operation period.

17. The method of claim 16, further comprising calculating, by the central controller, the operation mode information that is inversely proportional to a difference between room temperature values at a start point of the first operation period and an end point of the first operation period, or the operation mode information that is proportional to a temporal size of the first operation period.

18. The method of claim 16, further comprising determining, by the central controller, a calculation point in time for the operation mode information based on a room temperature value at an end point of the first operation period, or a calculation point in time for the operation mode information based on a temporal size of the first operation period.

19. The method of claim 16, further comprising:

controlling a learning unit of the air conditioner to calculate the operation mode information, the learning unit including an input layer configured to receive an input value, an output layer configured to output the operation mode information, and one or more hidden layers that are disposed between the input layer and the output layer;

controlling the learning unit to receive an input of the sensed room temperature values or sensed room temperature value changes, and to output the operation mode information;

controlling the learning unit to update weights of nodes or edges between a node composing the input layer and a node composing the output layer during a learning process of the learning unit; and controlling the input layer to receive inputs of a room temperature during the suspended period, a target temperature, a rate of room temperature rise or fall with respect to the target temperature, a room size, or load information.

20. The method of claim 11, when the interrupt input for changing speed, volume or temperature of the air is input after the air conditioner is operated based on the operation mode information, then the central controller calculates new operation mode information using the interrupt input.

* * * * *